US006593281B2

(12) United States Patent
Sato et al.

(10) Patent No.: US 6,593,281 B2
(45) Date of Patent: Jul. 15, 2003

(54) LUBRICATING OIL COMPOSITION FOR AUTOMATIC TRANSMISSION

(75) Inventors: Takehisa Sato, Chiba (JP); Takanori Kugimiya, Saitama (JP)

(73) Assignee: TonenGeneral Sekiyu K.K., Saitama (JP)

( * ) Notice: Subject to any disclaimer, the term of this patent is extended or adjusted under 35 U.S.C. 154(b) by 0 days.

(21) Appl. No.: 09/874,852

(22) Filed: Jun. 5, 2001

(65) Prior Publication Data

US 2002/0187903 A1 Dec. 12, 2002

(30) Foreign Application Priority Data

Jun. 5, 2000 (JP) ..... 2000-167142

(51) Int. Cl.[7] ..... C10M 141/06; C10M 139/00
(52) U.S. Cl. ..... 508/192; 508/199; 508/391
(58) Field of Search ..... 508/192, 199, 508/391

(56) References Cited

U.S. PATENT DOCUMENTS 5,629,272 A * 5/1997 Nakazato et al. ..... 508/185
5,922,656 A * 7/1999 Yoshimura et al. ..... 508/408
6,127,323 A * 10/2000 Watts et al. ..... 508/291
6,140,279 A * 10/2000 Emert et al. ..... 508/192
6,232,275 B1 * 5/2001 Ichihashi et al. ..... 508/192
6,352,962 B1 * 3/2002 Hata et al. ..... 508/188

* cited by examiner

*Primary Examiner*—Jacqueline V. Howard
(74) *Attorney, Agent, or Firm*—Linda M. Scuorzo

(57) ABSTRACT

To provide a lubricating oil composition for automatic transmission which ensures both a high torque capacity of a wet clutch and a good $\mu$(coefficient of friction)-V (sliding velocity) characteristic in an automatic transmission along with excellent storage stability in a high humidity environment.

A lubricating oil composition for automatic transmission is provided, which comprises a lubricating base oil made of a mineral oil and/or a synthetic oil formulated with a friction modifier, a metal detergent and an ashless dispersant, characterized in that said ashless dispersant consists of an succinimide having boron at a rate of three or less atoms in one molecule of the ashless dispersant.

5 Claims, No Drawings

LUBRICATING OIL COMPOSITION FOR AUTOMATIC TRANSMISSION

This application claims priority to Japanese Patent Application No. 167142/00 filed Jun. 5, 2000.

FIELD OF THE INVENTION

This invention relates to a lubricating oil composition for automatic transmissions.

BACKGROUND OF THE INVENTION

The lubricating oil for automatic transmission is one that is used for automatic transmissions such as those of automobiles and the like having a torque converter, a gearing, a hydraulic mechanism, a wet clutch built therein. The lubricating oil for automatic transmission is required to have many functions as a transmission medium of power against a torque converter, a hydraulic system, a control system and the like, a lubricating medium or a heating medium for temperature control against gearings, bearings, a wet clutch and the like, and also as a lubricating medium or a friction characteristic lock-up medium or the like for friction plates.

A lock-up clutch that is effective in improving a fuel cost has been recently adopted for an automotive automatic transmission. Under this arrangement, the transmission is built in a torque converter. The lock-up clutch functions to transmit the drive power of an engine directly to the transmission depending on the travelling conditions and effect the change over between the drive of the torque converter and the direct drive at an appropriate timing, thereby improving the efficiency of the torque converter.

The lubricating oil required for such an automatic transmission as set out hereinabove should be one that has a good $\mu$ (coefficient of friction)-V (sliding velocity) characteristic, i.e. the degree in reduction of the coefficient of friction depending on the increase in relative sliding velocity is small, or the oil has such a friction characteristic of a positive gradient that the coefficient of friction increases with an increasing sliding velocity.

In the lubricating oil for automatic transmission, there has been hitherto proposed the use, as a friction modifier, of phosphoric esters, fatty acid esters, fatty acid amides and the like as set out, for example, in Japanese Patent Application Laid-open No. Sho 63-2544196. However, the formation of such a friction modifier as mentioned above has a difficulty in that the coefficient of friction is lowered within a range of a low sliding velocity of the lock-up clutch, thereby causing a transmission torque capacity to become insufficient at the time of clutch coupling.

For the purpose of increasing the transmission torque capacity, we have already proposed the use of at least one of a metal alkylphenate and a metal alkylphenate sulfide in Japanese Patent Application Laid-open No. Hei 5-105892, the use in combination of a metal salt of an organic acid such as calcium sulfonate or the like with a specific type of polyamide compound in Japanese Patent Application Laid-open No. Hei 8-319494, and the formulation, in a base oil, of a metal salt of an organic acid, a specific type of polyamide compound, and an acidic phosphoric ester, etc. in Japanese Patent Application Laid-open No. Hei 10-265793.

Further, there have been proposed, in Japanese Patent Application Laid-open No. Hei 9-328697, a lubricating oil composition for automatic transmission having excellent shudder proofness wherein a sulfur-containing antioxidant, phosphoric esters and a reaction product between a carboxylic acid and an amine are formulated in a base oil, in Japanese Patent Application Laid-open No. Hei 10-306292, a lubricating oil composition for automatic transmission having excellent shudder proofness wherein Ca-sulfonate having a specified total base number and phosphites are formulated, and, in Japanese Patent Application Laid-open No. Hei 11-116982, a lubricating oil composition having excellent shudder proofness wherein calcium sulfonate, etc., zinc dithiophosphate and a bisphenol antioxidant are formulated.

However, in spite of these proposals, the friction plate of wet clutch is clogged when used over a long time, with the attendant problem that the coefficient of friction at the lock-up clutch lowers and a friction characteristic such as a $\mu$-V characteristic is worsened. The clogging of the friction plate is considered, as one factor, to result from the formation, in a lubricating oil, of a precipitate insoluble in the lubricating oil. Especially, in order to obtain both a high torque capacity of a wet clutch and a good $\mu$-V characteristic, it is effective to formulate a boron-containing succinimide ashless dispersant. In the use of the dispersant, a precipitate may be formed, in some case, in a lubricating oil when moisture is present, thus leading to the problem on the possibility of the clogging of the friction plate and the blocking of a lubricating oil path.

SUMMARY OF THE INVENTION

The invention provides a lubricating oil composition for automatic transmission, which has both a high wet clutch torque capacity and a good $\mu$-V characteristic (i.e., positive with respect to the gradient thereof) and enhanced storage stability in a high humidity environment. Herein $\mu$ means coefficient of friction and V means sliding velocity.

Applicants have found that when at least three additives including a friction modifier (A), a metal detergent (B), and a specific type of ashless dispersant (C) are formulated in a lubricating base oil as essential components, there can be obtained a lubricating oil composition for automatic transmission which has both a high torque capacity of a wet clutch, i.e., a satisfactory coefficient of friction in a high sliding velocity region, and such a property that the $\mu$-V characteristic is positive in gradient, both required for the lubricating oil for automatic transmission and which also has excellent storage stability in a high humidity environment.

More particularly, according to an embodiment of the invention, there is provided a lubricating oil composition of automatic transmission of the type wherein a friction modifier (A), a metal detergent (B), and a specific type of ashless dispersant (C) are formulated in a lubricating base oil made of a mineral oil and/or a synthetic oil, characterized in that said ashless dispersant consists of a succinimide containing boron at a rate of three or less atoms in one molecule of the ashless dispersant.

As stated above, the invention relates to a lubricating oil composition wherein at least three specific types of compounds are formulated in a lubricating base oil. Preferred embodiments include those set forth below.

(1) A lubricating oil composition for automatic transmission, wherein the amount of the friction modifier ranges from 0.01–5 wt % based on the total weight of the composition.

(2) A lubricating oil composition for automatic transmission, wherein the amount of the metal detergent ranges from 0.1–7 wt % based on the total weight of the composition.

(3) A lubricating oil composition for automatic transmission, wherein the amount of the ashless dispersant ranges from 0.1–10 wt % based on the total weight of the composition.

(4) A lubricating oil composition for automatic transmission, wherein the friction modifier is made of an amine friction modifier and/or a boron-containing alcohol friction modifier.

(5) A lubricating oil composition for automatic transmissions, wherein the metal detergent is an alkaline earth metal salt of an alkylbenzene or alkylnaphthalenesulfonic acid, an alkaline earth metal salt of an alkylphenol sulfide or an alkaline earth metal salt of an alkylsalicyclic acid.

(6) A lubricating oil composition for automatic transmission, wherein the metal detergent has a total base number ranging 100–400 mg KOH/g.

(7) A lubricating oil composition for automatic transmission, wherein the ashless dispersant is made of a succinimide having boron at a rate of 1.5 atoms or less per molecule of the ashless dispersant.

The present invention may comprise, consist or consist essentially of the elements or steps disclosed and may be practiced in the absence of a step or element not disclosed as required and includes the products produced by the processes disclosed herein.

DETAILED DESCRIPTION OF THE PREFERRED EMBODIMENTS

The embodiments of invention are described in detail below.

Lubricating Base Oil

The base oil used in the lubricating oil composition for automatic transmission of the invention is not critical in type; any ones ordinarily used as a lubricating base oil may be employed. More particularly, oils falling under this category include mineral oils, synthetic oils or mixed oils thereof.

The base oil used in the practice of the invention should have a kinematic viscosity, at 100, ranging 0.5–200 m/s, preferably 2–25 $mm^2/s$, and more preferably 3.5–8 $mm^2/s$. If the kinematic viscosity of the base oil is too high, the viscosity at a low temperature becomes poor. In contrast, when the kinematic viscosity is too low, there arise difficulties that a wear may occur at a sliding portion of an automatic transmission and that a flash point becomes low.

The mineral oil consists of a hydrocarbon oil fraction having a lubricating oil viscosity. For example, there may be used a hydrocarbon oil, which is obtained by treating a vacuum distillate with an aromatic extraction solvent, such as phenol, fufural or N-methylpyrrolidone to obtain a raffinate, subsequently subjecting the raffinate to dewaxing with a solvent such as propane, methyl ethyl ketone or the like and, if necessary, further subjecting to hydro-refining to obtain a hydrocarbon oil, or a mixture of this hydrocarbon distillate oil with a residual oil obtained after the solvent extraction, dewaxing with a solvent and deasphalting with a solvent. From the standpoint of oxidation stability, it is preferred that the ratio of the aromatic carbon atoms to the total carbon atoms % $C_A$ (method of D3238 in ASTM) is 20 or below, more preferably 10 or below. From the standpoint of a pour point, the pour point should preferably be at −10° C. or below, more preferably at −15° C. or below. These refined mineral oils may be compositionally made of paraffin, naphthene and the like oils, and may be used singly or may be made of a mixed hydrocarbon thereof. Specific examples of the mineral oils include light neutral oils, medium neutral oils, heavy neutral oils and bright stocks, which are appropriately mixed so as to satisfy required properties, thereby preparing a base oil.

The synthetic oils used in the invention include olefin oligomers, dibasic acid esters, polyol esters, polyalkylene glycols, polyethers, alkyl-benzenes, alkylnaphthalenes and the like.

The olefin oligomer is selected from those products that are obtained by homopolymerizing an arbitrary one selected from linear or branched olefins having 2–14 carbon atoms, preferably from 4–12 carbon atoms or by copolymerizing two or more olefins, with an average molecular weight ranging 10- about 3,000, preferably 200- about 1,000. Preferably, those products wherein unsaturated bonds are removed through hydrogenation are preferred. Preferred examples of the olefin oligomer include polybutene, $\alpha$-olefin oligomers, ethylene•$\alpha$-olefin oligomers and the like.

The dibasic acid esters include esters of aliphatic dibasic acids having 4–14 carbon atoms and aliphatic alcohols having 4–14 carbon atoms. The polyesters include esters of polyhydric alcohols such as neopentyl glycol, trimethylolpropane, pentaerytliritol and the like and aliphatic acids having 4–18 carbon atoms. In addition, esters of hydroxy acids such as hydroxypivalic acid, aliphatic acids and alcohols may also be used.

Examples of the polyoxyalkylene glycols include polymerized products of alkylene oxides having 2–4 carbon atoms. The alkylene oxides may be polymerized singly or in admixture thereof. The polymer of a mixture of alkylene oxides may be either a block polymer or a random polymer. The alkylene glycol may be blocked with an ether or ester at one or both ends thereof. Phenyl ether or the like may be used as the polyether.

These base oils may be used singly or in combination of two or more, and a mineral oil and a synthetic oil may be used in combination.

Additives

The components (A)–(C) used in the lubricating oil composition of the invention by formulation in a base oil are described below.

The friction modifier used as the component (A) should satisfy a good $\mu$-V characteristic and a high wet clutch torque capacity through the combination thereof with the metal detergent used as the component (B) and the specific type of ashless dispersant serving as the component (C), and favorably include friction modifiers of fatty acids, higher alcohols, fatty acid esters, oils and fats, imide compounds, boron-containing cyclic carboxylic acid imides and the like. Of these, the friction modifier made of an amine compound or a boron-containing alcohol is favorably used. The friction modifier made of an amine compound includes an alkylamine, an alkyldiamine, a dialkylamine or a trialkylamine, each having 4–36 carbon atoms. Preferably, an alkylamine or a dialkylamine is used. The boron-containing alcohol friction modifier includes a reaction product between an aliphatic monoalcohol, an aliphatic polyhydric alcohol or/an alkylene glycol and boric acid. The amount of the friction modifier ranges 0.01–5 wt % based on the total weight of the composition. If the amount is less than 0.01 wt %, the $\mu$-V characteristic becomes unsatisfactory. On the other hand, when the amount exceeds 5 wt %, the coefficient of friction lowers, so that there cannot be obtain a high torque capacity of a wet clutch.

The metal detergent used as the component (B) in the lubricating oil composition of the invention includes a salicylate, carboxylate, sulfonate, phenate or phosphonate having an alkaline earth metal or an alkali metal in the molecule and capable of being dissolved or uniformly dispersed in a lubricating base oil. Specific examples include alkaline earth metal salts of alkylsalicylic acids, alkaline earth metal salts of naphthenic acid or phthalic acid having an alkyl substituent, alkaline earth metal salts of petroleum sulfonic acid, alkyl-benzenesulfonic acids or alkylnaphthalenesulfonic acids, alkaline earth metal salts alkylphenol sulfides or alkaline earth metal salts of thiophosphonic acid or phosphonic acid having a hydrocarbon group. Calcium (Ca) salts, magnesium (Mg) salts and barium (Ba) salts are favorably used. Alternatively, alkali metal salicylates, carboxylates, sulfonates, phenates or phosphonates may also be used. Sodium (Na) or potassium (K) are used as the alkali metal. Of these, it is preferred from the standpoint of the effectiveness to use an alkaline earth metal salicylate or sulfonate.

These metal detergents should generally have a total base number (TBN) [as measured by JIS K2501 (perchloric acid method)] ranging 10–450 mg KOH/g, preferably 100–400 mg KOH/g. With respect to a soap content, those having a content of 20–50 wt %, preferably 30–45 wt %, are usable.

In the practice of the invention, the metal detergents may be used singly or in combination of two or more. The amount of the metal detergent ranges 0.1–7 wt % based on the total weight of the composition, preferably 0.5–5 wt %. If the amount is less than 0.1 wt %, the coefficient of friction in a high sliding velocity region lowers, so that a required $\mu$-V characteristic cannot be obtained. On the other hand, when the amount exceeds 7 wt %, oxidation stability deteriorates.

The ashless dispersant used as the component (C) in the lubricating composition of the invention is made of a boron-containing succinimide wherein it is necessary that boron be contained at a rate of three atoms or below in one molecule of the ashless dispersant. It is preferred to use a succinimide having boron at a rate of 1.5 atoms or below in one molecule of the ashless dispersant. The content of boron at a rate of 3 atoms or below in one molecule of the ashless dispersant ensures excellent storage stability in a high humidity environment.

The boron-containing succinimide includes those obtained by treating a mono or bis product of succinimide with a boron compound. Preferably, a boron-containing product of a polyalkyl or polyalkenylsuccinimide is used.

The polyalkyl or polyalkenylsuccinimide can be usually prepared by reaction, with a polyalkylenepolyamide, of a polyalkyl or polyalkenylsuccinic acid anhydride obtained by reaction between a polyolefin and maleic anhydride. The mono and di products of the polyalkyl or polyalkenylsuccinimide can be prepared by changing the reaction ratio between the polyalkyl or polyalkenylsuccinic acid anhydride and the polyalkylenepolyamine. The polyolefin used as a starting material for the preparation of the polyalkyl or polyalkenylsuccinimide is appropriately selected from those obtained by polymerizing olefins having approximately 2–8 carbon atoms. The olefins used for the formation of polyolefins may be uses singly or in combination of two or more. Polybutene is preferred as the polyolefin.

With respect to polyalkenepolyamine, examples include polyethylenepolyamine, polypropylenepolyamine, polybutylenepolyamide and the like, for example. Of these, polyethylenepolyamide is preferred.

The product obtained by treating a polyalkyl or polyalkenyl-succinimide with boron used in the invention can be prepared in a usual manner. The content of boron in the boron-treated product usually ranges 0.1–5 wt %, preferably 1 wt % or over, based on the total weight of the boron-containing succinimide.

In the lubricating oil composition of the invention, the specific type of boron-containing succinimide used as the component (C) is usually contained in the range of 0.1–10 wt %, preferably 0.2–6 wt %, based on the total weight of the composition. If the amount of the boron-containing succinimide is less than 0.1 wt %, a desired effect (i.e., an effect of increasing a coefficient of friction in a high sliding velocity region) is not satisfactorily shown. On the other hand, when the amount exceeds 10 wt %, the desired effect is not shown further more (i.e., an effect corresponding to the increase in amount is not obtained).

When the lubricating oil composition of the invention, which comprises these three types of additives as essential components, is employed as a lubricating oil for automatic transmission, such remarkable effects are achieved that both a high torque capacity of a wet clutch and a good $\mu$-V characteristic that are required for a lubricating oil for automatic transmission can be imparted along with excellent storage stability in a high humidity environment.

Other Additive Components

The lubricating oil compositions comprise, the three types of compounds as set forth hereinabove formulated in a lubricating base oil. If necessary, various types of additives ordinarily used in ATF may be appropriately added to within ranges not impeding the purposes of the invention, including a wear preventive, a metal deactivator, an antioxidant, a viscosity index improver, a pour point depressant, an antifoam agent, an antirusting agent, a colorant and the like.

The wear preventive includes a phosphorus-based wear preventive such as phosphoric acid, phosphates, acid phosphate esters, phosphorus acid esters, acid phosphate esters, phosphonates, acid phosphonates, acid phosphate amine salts, acid phosphite amine salts, acid phosphonate amine salts and the like. Alternatively, zinc primary, secondary or their mixed alkyldithio-phosphates may also be used. Moreover, there may be further used sulfur-containing wear preventives such as oil and fat sulfides, olefin sulfides, dihydrocarbyl polysulfides, mineral oil sulfides, thiocarbamates, thioterpenes, dialkyl dipropionates and the like. Of these, it is preferred to use acid phosphate esters, acid phosphite esters, phosphoric acid or mixtures thereof. These are usually used in an amount of 0.05–5 wt %.

The metal deactivator includes benzotriazole, thiadiazole and derivatives thereof. The combination of compounds of the benzotiazole type and the thiadiazole type are preferred because of the remarkable improvement in oxidation stability caused by the combination. These are usually used in an amount of 0.001–3 wt %.

Preferred antioxidants include hindered phenols and amines. The use in combination of these is preferred because of the remarkable improvement in oxidation stability. Favorable phenolic antioxidants include 4-methyl-2,6-ditertiary butylphenol, 4,4-methylene-bis-2,6-ditertiary butylphenol and the like. The amine antioxidants include phenylnaphthylamine, an alkylphenyl-diphenylamine, diphenylamine, an alkyldiphenylamine and the like. These are usually employed in an amount of 0.05–5 wt %.

The viscosity index improver includes an olefin copolymer such as an ethylene-propylene copolymer or the like, a polyacrylate, a polymethacrylate or the like. In view of its low temperature viscosity, a polymethacrylate is preferably used. These are usually used in an amount of 1–20 wt %.

The pour point depressant usually includes an ethylene-vinyl acetate copolymer, a condensate of chlorinated paraffin and naphthalene, a condensate of chlorinated paraffin and phenol, a polymethacrylate, a polyakylstyrene or the like. These are generally used in an amount of 0.01–5 wt %.

An antifoam agent includes a silicone compound such as dimethyl-polysiloxane or the like, sorbitan monolaurate, or an ester compound such as an alkenylsuccinic acid derivative. These are usually used in an amount of 0.0001–2 wt %.

Moreover, a corrosion inhibitor, a colorant and the like additives may be used in the lubricating oil composition of the invention, if desired.

EXAMPLES

The invention is described in more detail by way of examples and comparative examples. The invention should not be construed as limiting to these examples. It will be noted that the $\mu$-V characteristic, a torque capacity of a wet clutch and storage stability were, respectively, evaluated according to the following procedures.

(1) $\mu$-V characteristic

The testing method of the $\mu$-V characteristic was accorded to an automatic transmission oil shudder preventing performance testing method of JASO M349-98. For the friction plate, there were used a friction plate (friction plate: D-0512) and a steel plate, defined in JASO M349-98.

(2) Torque Capacity of Wet Clutch

The torque capacity of a lubricating oil for automatic transmission was determined according to an automatic transmission oil friction characteristic testing method defined in JASO M348-95 wherein a SAE No. 2 testing machine was used to measure a coefficient of friction ($\mu$t) of a test oil during 500 cycles, thereby evaluating a transmittable torque capacity at a wet clutch portion. It is considered that a higher coefficient of friction ($\mu$t) results in a larger torque capacity, and a test oil having a coefficient of friction of 0.13 or over is judged as acceptable.

Test Conditions

Friction plate: wet paper member

Test temperature: 100° C.

Amount of oil: 800 ml

Surface pressure: 8 kgf/cm$^2$ (3) Storage Stability

The storage stability was such that for simulation of a high humidity environment, 20 ml of a test oil placed in a 100 ml beaker was allowed to stand in a desiccator, in which water was placed, under conditions of room temperature in a saturated humidity atmosphere, thereby visually observing the presence or absence of turbidity and a precipitate. If no precipitate was observed, the stability was judged as good.

(4) Examples and Comparative Examples

Example 1

A solvent-refined paraffin mineral oil (having a kinematic viscosity of 4 mm$^2$/s at 100° C.) was used as a base oil. The base oil was formulated, based on the total weight of a composition, with 0.1 wt % of oleylamine used as a friction modifier of component (A), 1.0 wt % of Ca sulfonate used as a metal detergent of component (B), 1.0 wt % of boron-containing succinimide, which has 0.9 boron atoms per molecule as an ashless dispersant of component (C), and 10.0 wt %, in total, of given amounts of other additives including a wear preventive, an antioxidant, a viscosity index improver, a metal deactivator and an antifoam agent, thereby preparing a lubricating oil composition. The details of the formulated additives are described below.

The friction modifier of component (A) is made of oleylamine of an amine compound.

Ca sulfonate of component (B) is Ca alkylbenzene-sulfonate having a total base number of 300 mg KOH/g.

The boron-containing succinimide of component (C) is made of boron-containing polybutenylsuccinimide having a molecular weight (MW) of 1400 wherein boron atoms are contained at a rate of 0.9 in one molecule of the ashless dispersant (i.e. boron-containing succinimide).

The thus prepared lubricating oil composition was evaluated with respect to the $\mu$-V characteristic, SAE No. 2 friction characteristic and storage stability. These results are shown in Table 1. The properties in Example 1 are, respectively, good.

Example 2

Similar to Example 1, the base oil component and additive components indicated in Table 1 were formulated at such ratios as indicated in the table to prepare a lubricating oil composition. The thus prepared lubricating oil composition was subjected to evaluation of the $\mu$-V characteristic, SAE No. 2 friction characteristic and storage stability. The results are shown in Table 1. Like Example 1, the results of the evaluation in Example 2 were good.

Comparative Examples 1–4

The lubricating base oil component and various types of additive components indicated in Table 1 were, respectively, formulated at such ratios indicated in the table, thereby preparing lubricating oil compositions. The thus prepared lubricating oil compositions were, respectively, subjected to evaluation of the $\mu$-V characteristic, SAE No. 2 friction characteristic and storage stability. The results are shown in Table 1.

TABLE 1

| | | Example 1 | Example 2 | Comp. Ex. 1 | Comp. Ex. 2 | Comp. Ex. 3 | Comp. Ex. 4 |
|---|---|---|---|---|---|---|---|
| Composition | Base oil *1 | Balance | Balance | Balance | Balance | Balance | Balance |
| | (A) friction modifier *2 (wt %) | 0.1 | 0.1 | 0.1 | — | 0.1 | 0.1 |
| | (B) Ca sulfonate *3 (wt %) | 1.0 | 1.0 | 1.0 | 1.0 | — | 1.0 |
| | (C) boron-containing succinimide *4 (wt %) | 1.0 | — | — | — | — | — |
| | boron-containing succinimide *5 (wt %) | — | 1.0 | — | 1.0 | 1.0 | — |
| | boron-containing succinimide *6 (wt %) | — | — | 1.0 | — | — | — |
| | succinimide *7 (wt %) | — | — | — | — | — | 1.0 |
| | Boron atoms in one molecule of ashless dispersant | 0.9 | 1.2 | 7.1 | 1.2 | 1.2 | — |
| | Other additives *8 (wt %) | 10.0 | 10.0 | 10.0 | 10.0 | 10.0 | 10.0 |

TABLE 1-continued

| | Example 1 | Example 2 | Comp. Ex. 1 | Comp. Ex. 2 | Comp. Ex. 3 | Comp. Ex. 4 |
|---|---|---|---|---|---|---|
| $\mu$-V characteristic dμ/dv (50) | Positive | Positive | Positive | Negative | Negative | Positive |
| dμ/dv (150) | Positive | Positive | Positive | Negative | Negative | Negative |
| SAE No. 2 friction characteristic (transmission torque capacity) · coefficient of friction μt @ 500 cycles | 0.132 | 0.133 | 0.128 | 0.136 | 0.127 | 0.134 |
| Storage stability @ room temperature, one week, saturated humidity atmosphere · presence of absence of precipitate | no | no | yes | no | no | no |

*1: Solvent-refined paraffin mineral oil (kinematic viscosity of 4 $mm^2/s$ at 100° C.)
*2: Oleylamine
*3: Ca alkylbenzenesulfonate with a total base value of 300 mg KOH/g
*4: Product having an average molecular weight of 1400 and 0.9 carbon atoms in one molecule of ashless dispersant
*5: Product having an average molecular weight of 1800 and 1.2 carbon atoms in one molecule of ashless dispersant
*6: Product having an average molecular weight of 1600 and 7.1 carbon atoms in one molecule of ashless dispersant
*7: Ashless dispersant made of a boron-free succinimide with an average molecular weight of 1400
*8: Wear preventive, antioxidant, viscosity index improver, metal deactivator, antifoam agent added to as other additives each in a given amount

What is claimed is:

1. A lubricating oil composition for automatic transmission of the type which comprises a lubricating base oil made of a mineral oil and/or a synthetic oil formulated with a friction modifier, a metal detergent and an ashless dispersant, wherein the ashless dispersant consists of a boron-containing succinimide having boron at a rate of three or less atoms per molecule of the ashless dispersant.

2. The composition of claim 1 wherein the amount of friction modifier ranges from 0.01–5 wt %, based on the total weight of the composition and the metal detergent ranges from 0.1–7 wt %.

3. The composition of claim 1 wherein the friction modifier is selected from an amine friction modifier, a boron-containing alcohol friction modifier and mixtures thereof.

4. The composition of claim 1 wherein the metal detergent has a TBN of 100–400 mg KOH/g.

5. A method for lubricating an automatic transmission by providing to the automatic transmission an effective lubricating amount of the lubricating oil composition of claim 1.

* * * * *